US006550275B2

(12) United States Patent
Steinberg

(10) Patent No.: US 6,550,275 B2
(45) Date of Patent: Apr. 22, 2003

(54) ROUNDED GEMSTONE SETTING

(75) Inventor: Daniel R. Steinberg, 1141 Liberty Bell Dr., Cherry Hill, NJ (US) 08003

(73) Assignee: Daniel R. Steinberg, Caesarea (IL)

( * ) Notice: Subject to any disclaimer, the term of this patent is extended or adjusted under 35 U.S.C. 154(b) by 48 days.

(21) Appl. No.: 09/790,774

(22) Filed: Feb. 23, 2001

(65) Prior Publication Data

US 2002/0116948 A1 Aug. 29, 2002

(51) Int. Cl.[7] ..... A44C 17/02
(52) U.S. Cl. ..... 63/28; 63/26
(58) Field of Search ..... 63/26–32; D11/89–92

(56) References Cited

U.S. PATENT DOCUMENTS 802,267 A * 10/1905 Chaumet ..... 63/28
1,440,229 A * 12/1922 Mestekin ..... 63/28
1,449,158 A * 3/1923 Wittstein ..... 63/28
4,813,246 A 3/1989 Richards
5,072,601 A * 12/1991 Slowinski ..... 63/28
5,123,265 A 6/1992 Ramot
5,533,364 A 7/1996 Freilich
5,848,539 A 12/1998 Ouzounian
6,003,335 A 12/1999 Gurevich
6,065,307 A 5/2000 Freilich
D454,090 S * 3/2002 Kaplan ..... D11/91

* cited by examiner

*Primary Examiner*—J. J. Swann
*Assistant Examiner*—Ruth C. Rodriguez
(74) *Attorney, Agent, or Firm*—Stuart M. Goldstein

(57) ABSTRACT

A gemstone setting is disclosed with rounded gemstones with outer faceted surfaces, each gemstone forming an outwardly contoured or convex gemstone configuration which is invisibly set in flush, surface to surface, mating relation within the setting. A section of a rounded gemstone is cut away, leaving a concave inset within and a curved concave inner surface on the gemstone. This concave configuration allows the partially cut away gemstone to mate in flush, surface to surface relation with the convex outer surface of the adjacent gemstone. Grooves within the side facets of the gemstone invisibly set the gemstones in position within supporting housings. The setting of gemstones in this fashion, employing surface to surface flush mating contact, can be used in infinite jewelry designs which employ rounded, curved edge, contoured or generally convex configured gemstones.

16 Claims, 6 Drawing Sheets

ROUNDED GEMSTONE SETTING

BACKGROUND OF THE INVENTION

Precious and semiprecious gemstones are commonly combined and placed in settings to form different types of jewelry in an infinite number of designs and configurations. The gemstones are generally set in position by employing standard prong support elements or they can be invisibly set, that is supported and maintained in place so that the settings are beneath the visible surface of the gemstone and thus cannot be seen, thereby enhancing the aesthetic appearance of the stones. Such "invisible settings" are accomplished in a variety of ways, for instance as seen in U.S. Pat. Nos. 5,072,601, 5,123,265, and 6,003,335.

However, in all of these settings and in all prior settings in which gemstones are in flush surface to surface contact with each other to form a patterned design, the individual gemstones must be aligned and positioned such that the contact is between the linear, straight edges or girdles of the gemstones. U.S. Pat. Nos. 4,813,246, 5,533,364 and 6,065,307 show examples of linear, surface to surface settings.

Currently, when rounded gemstones are to be arranged in a pattern, by using either prongs or invisible setting methods, the gemstones in these settings are not positioned in flush, surface to surface relationship. Instead, the rounded gemstone in these settings contact each other at one point, for example as seen in U. S. Pat. No. 5,848,539. While such settings may be invisible, they are not as aesthetically pleasing, since unsightly openings or spaces are present between the gemstones. Curved, contoured or rounded gemstones, or those generally convex in configuration, invisibly set flush, in curved surface to surface, mating configuration has heretofore been unknown in the art.

SUMMARY OF THE INVENTION

It is thus an object of the present invention to provide a rounded gemstone setting which results in a unique, continuous gemstone pattern, in which gemstones are in flush, curved surface to surface contact, free of interspersed openings or spaces.

It is another object of the present invention to provide a rounded gemstone setting in which individual rounded, curved, contoured or convexly configured gemstones in the setting are invisibly set in flush, surface to surface, mating relation.

It is still another object of the present invention to provide a rounded gemstone setting in which gemstones can be invisibly set in flush, surface to surface, mating relation.

It is a further object of the present invention to provide a rounded gemstone setting which allows for a variety of patterns and designs of rounded, curved, contoured or convexly configured gemstones to be set invisibly, without unsightly spaces or cumbersome gemstone support mechanisms.

It is still another object of the present invention to provide a rounded gemstone setting which allows for the placement of individual rounded, curved, contoured or convexly configured gemstones to be placed inset with other gemstones, in flush, surface to surface relationship with one another, thus enhancing the appearance of the setting.

The present invention employs a gemstone setting with rounded gemstones with outer faceted surfaces, each gemstone forming an outwardly contoured or convex gemstone configuration which is invisibly set in flush, surface to surface, mating relation within the setting. A section of a rounded configured gemstone is cut away, leaving a concave inset within and a curved concave inner surface on the gemstone. This concave configuration allows the partially cut away gemstone to mate in flush, surface to surface relation with the convex outer surface of the adjacent gemstone. Grooves within the side facets of the gemstone invisibly set the gemstones in position within supporting housings. The setting of gemstones in this fashion, employing surface to surface flush mating contact, can be used in infinite jewelry designs which employ rounded, curved edge, contoured or generally convex configured gemstones.

The novel features which are considered as characteristic of the invention are set forth in particular in the appended claims. However, both as to their design, construction, and use, together with additional features and advantages thereof, they are best understood upon review of the following detailed description with reference to the accompanying drawings.

DETAILED DESCRIPTION OF THE INVENTION

Figure 1:
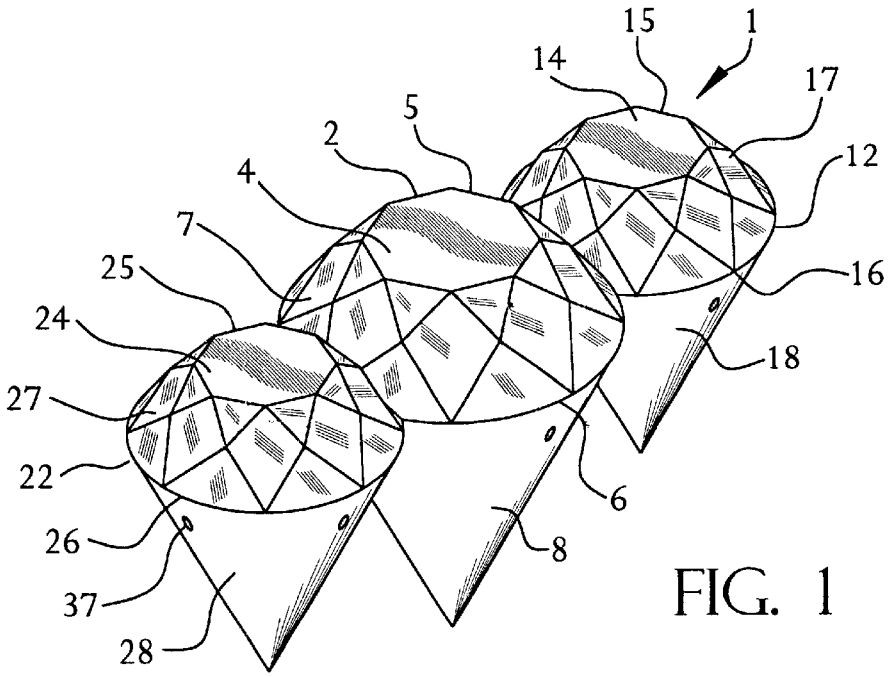
FIG. 1 is a perspective view of three gemstones set in accordance with the unique features of the present invention.

Gemstone setting 1 comprises gemstones 2, 12, and 22. Gemstone 2 comprises a top or table surface 4, outer table surfaces 5 defining table surface 4, and rounded edge or girdle 6 located in a different, but parallel transverse plane to and encircling table 4. Gemstone 2 has upper side facet surfaces 7 and lower facet 8. Outer surfaces 5 of top or table 4, upper facet surfaces 7, girdle 6, and lower facet 8 are configured to form a gemstone which has rounded or curved edges and is formed to assume a configuration which is outwardly contoured or convexly configured, which is common in the art.

Gemstones 12 and 22 each also comprise a top or table surface 14 and 24 respectively, with outer table surfaces 15 and 25 respectively, edge or girdle 16 and 26 respectively, in different but parallel transverse planes to and encircling tables 14 and 24, and upper side facet surfaces 17 and 27 and lower facets 18 and 28, respectively. Outer table surfaces 15 of table 14, upper facet surfaces 17, girdle 16, and lower facet 18 of gemstone 12, and outer table surfaces 25 of table 24, upper facet surfaces 27, girdle 26 and lower facet 28 of gemstone 22, are configured to generally form gemstones, like gemstone 2, which are outwardly contoured or configured convexly, with an important exception. Gemstones 12 and 22 each have a partial concave cut-out section 30 and 32, respectively.

Figure 2:
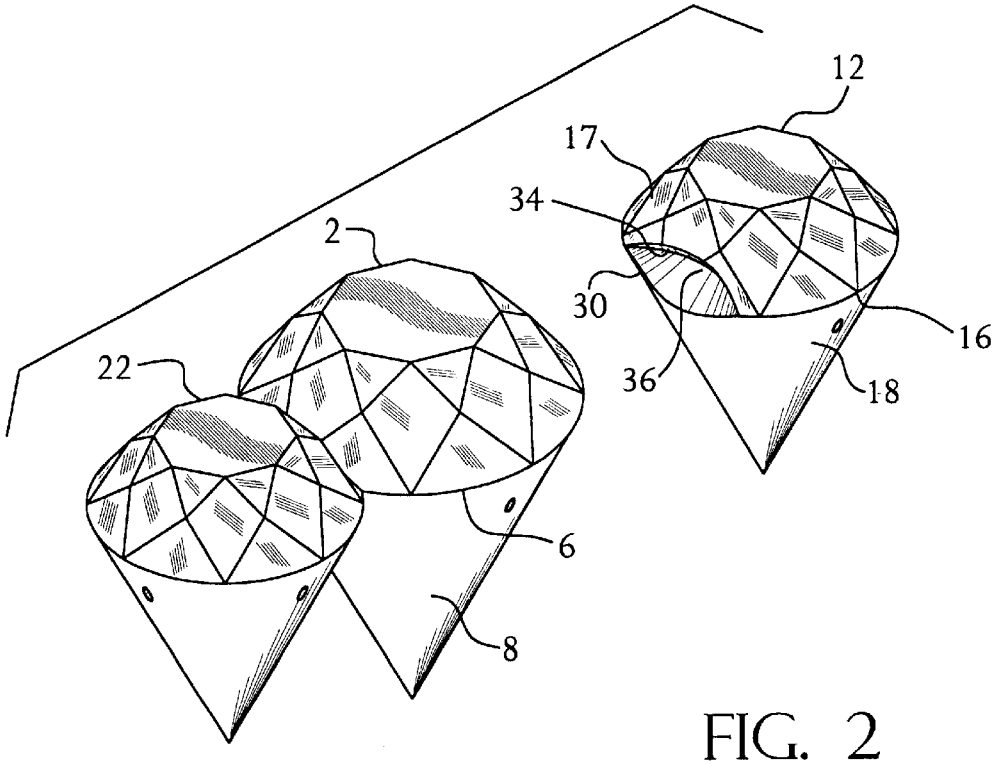
FIG. 2 is a perspective view, showing the surface to surface, flush mating gemstone setting of the present invention.
Figure 3:
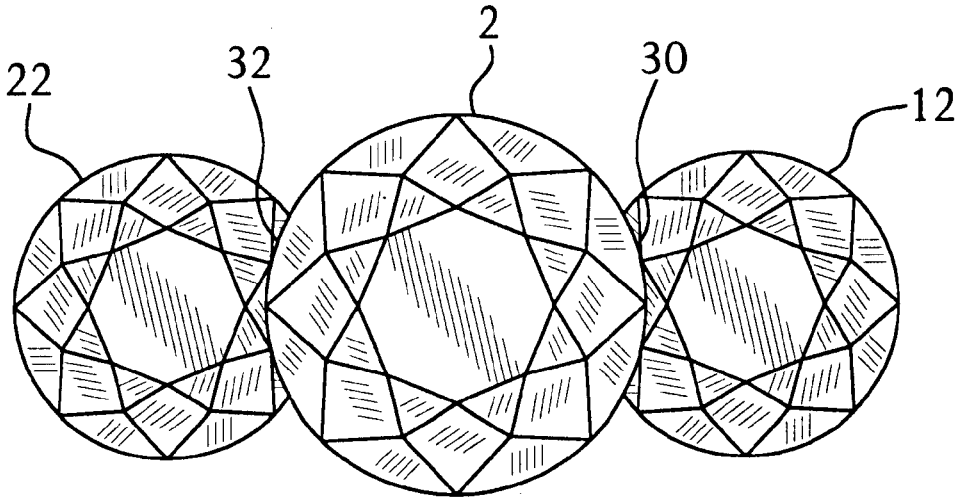
FIG. 3 is a top view of the gemstone setting shown in FIG. 1.
Figure 4:
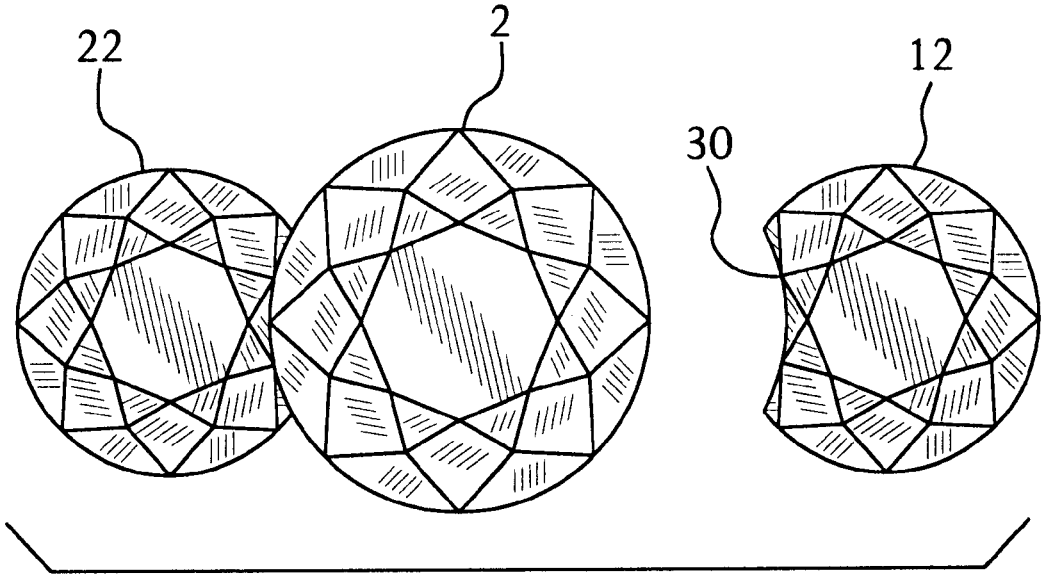
FIG. 4 is a top view of the gemstone setting shown in FIG. 2.
Figure 5:
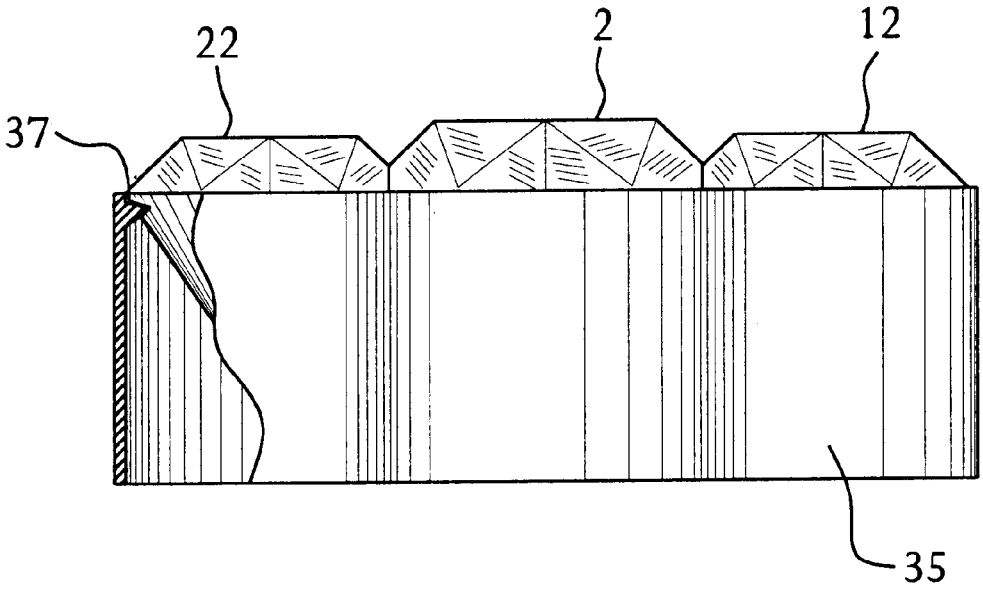
FIG. 5 is an elevation view of the gemstone setting shown in FIG. 1 with housing.
Figure 6:
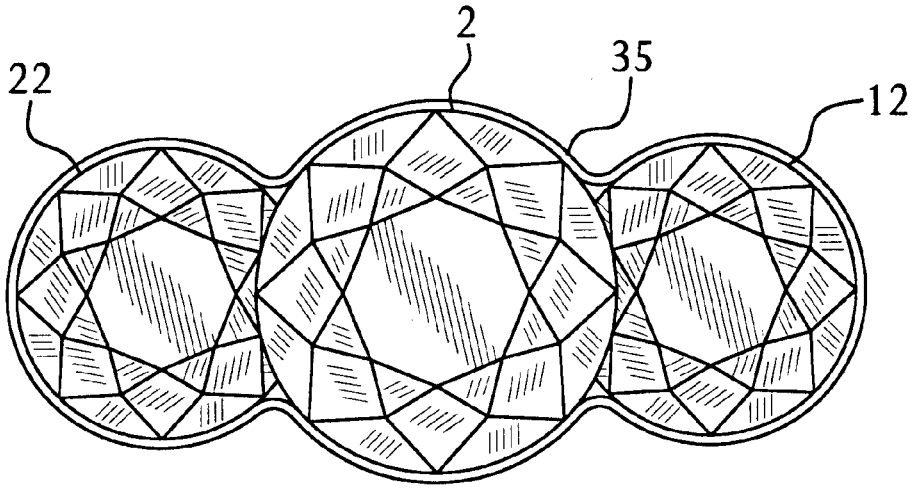
FIG. 6 is a top view of the gemstone setting shown in FIG. 5.
Figure 7:
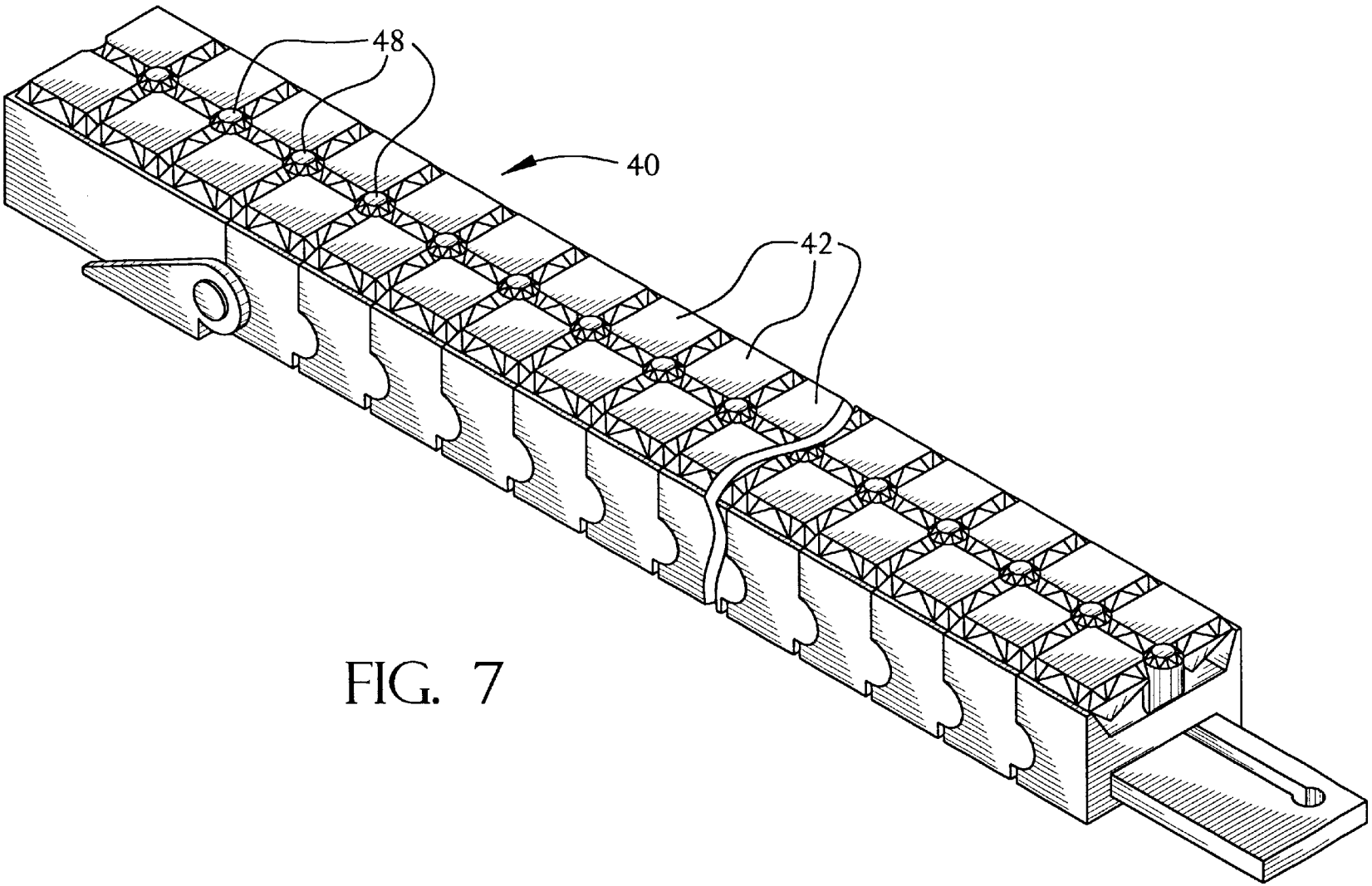
FIG. 7 is a perspective view of a bracelet employing the features of the present invention.
Figure 8:
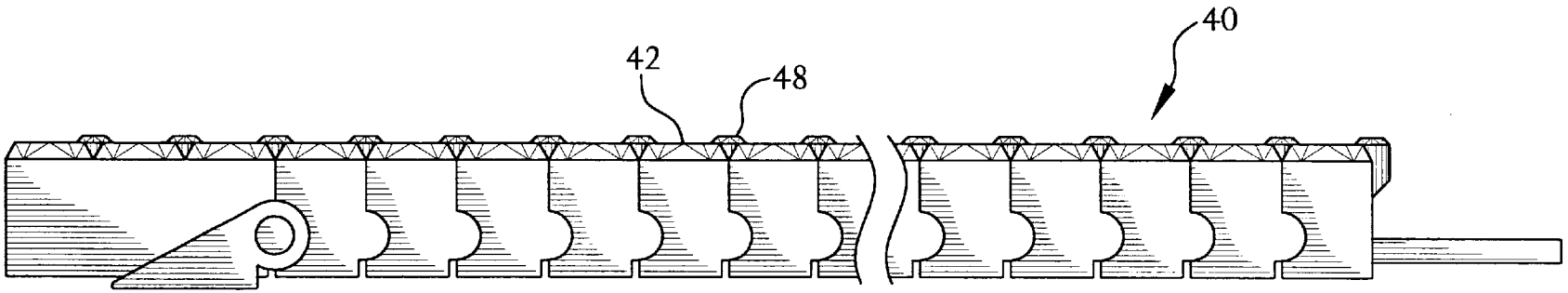
FIG. 8 is an elevation view of the bracelet in FIG. 6.

The cut-out configuration is most readily seen in FIG. 2, which shows cut-out 30 in gemstone 12. Cut-out 30 forms a concave inset, comprising concave inner surfaces 34 and 36, which are cut and inset from upper facet surfaces 17 and from lower facet 18. Concave inner surfaces 34 and 36 are positioned in parallel alignment with a portion of the outer surfaces of girdle 6, upper facet surfaces 7, and lower facet 8 of gemstone 2. Gemstone 22 is configured similar to gemstone 12 and is aligned on the other side of gemstone 2, as shown in FIGS. 1 and 2. By this setting, the outer surfaces of gemstone 2 are in flush, surface to surface mating contact with the inner concave surfaces of gemstones 12 and 22. Table surface 4 of gemstone 2 is set in a different transverse plane than table surfaces 14 and 24 of gemstones 12 and 22. However, gemstones 2, 12, and 22 can be set such that their respective table surfaces are located in the same transverse plane.

Housing 35 positions and invisibly sets gemstone 2, gemstone 12, and gemstone 22 in the above described, flush, surface to surface mating configuration. In this setting gemstones 2, 12 and 22 are secured in the housing by invisible grooved settings, for instance as shown at 37, which settings are well-known in the art.

While one embodiment of the cut-out configuration for a gemstone is described above, it is contemplated that different sections of a gemstone, i.e. any portion of the gemstone's outer faceted surfaces, may be cut-out in this manner for mating with another gemstone, in accordance with the jewelry design desired. The cut-out described above is not to be considered restrictive in any manner. It further can be appreciated that a plurality of gemstones, mating in the flush, concave surface to surface relationship disclosed by the invention, can be designed and set in infinite configurations and settings for rings, pins, necklaces, bracelets, and other types of jewelry.

Figure 10:
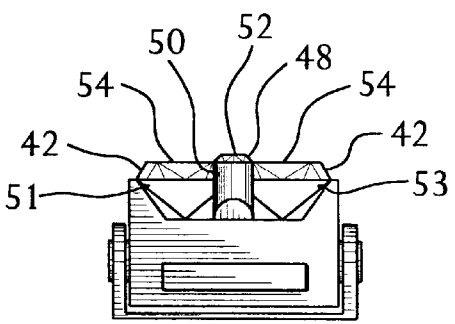
FIG. 10 is a second end view of the bracelet shown in FIG. 6.
Figure 9:
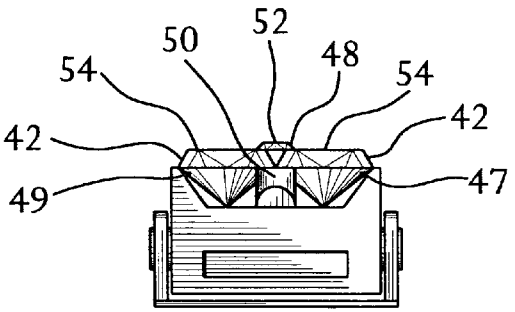
FIG. 9 is an end view of the bracelet in FIG. 6.
Figure 11:
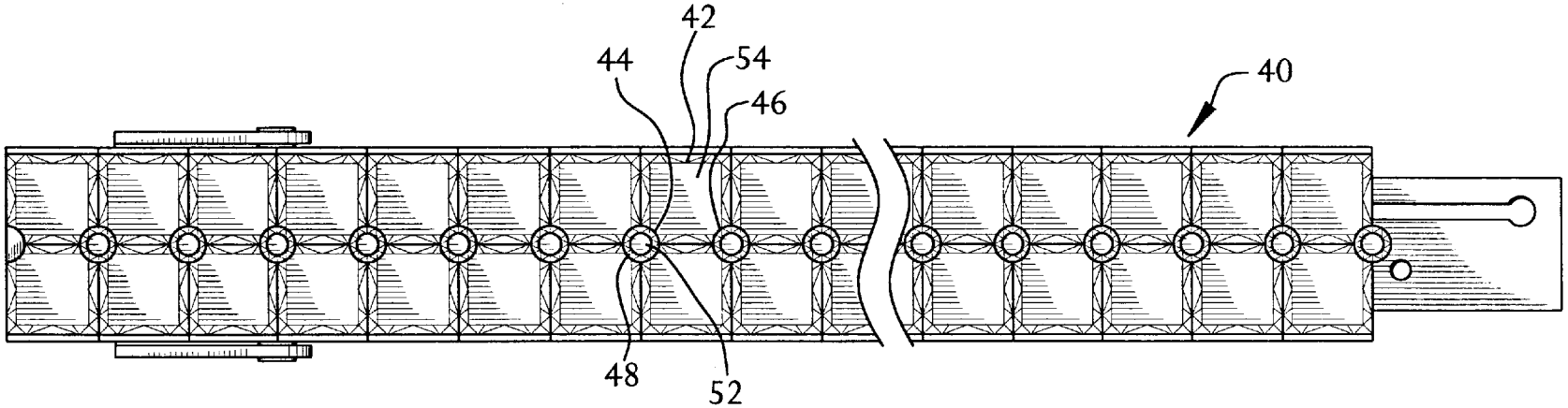
FIG. 11 is a top view of the bracelet shown in FIG. 6.
Figure 12:
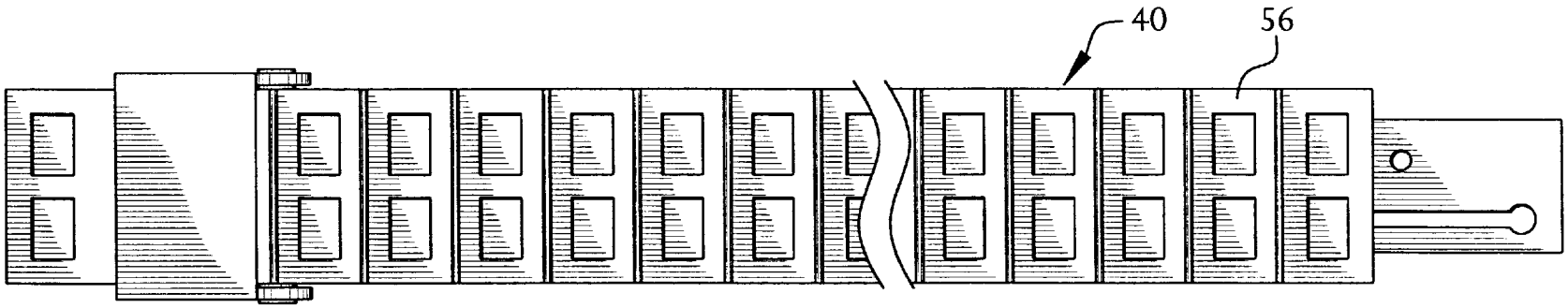
FIG. 12 is a bottom view of the bracelet shown in FIG. 6.

For instance, FIGS. 7–12 show just one example of how the gemstone settings of this invention can be employed. Bracelet 40 comprises a plurality of gemstones 42. Each gemstone 42 comprises concave cut-out portions 44 and 46, such as shown in FIG. 11. These gemstones are secured by conventional groove settings 47, 49, 51, and 53, as shown in FIGS. 9 and 10, in flush to flush mating relation with center gemstones 48. The concave inner surfaces of gemstones 42, resulting from the cut-out sections in each of these gemstones, are flushly mounted to the curved outer surfaces of housings 50 which invisibly set center gemstones 48. In this embodiment, center gemstones 48 can be mounted such that their table surfaces 52 are raised and positioned in a different transverse plane than the table surfaces 54 of gemstones 42 and 40. For completeness, FIG. 12 shows the bottom 56 of bracelet 40, which is of conventional configuration.

While several embodiments of the invention have been described the scope of protection to which the invention is believed entitled is defined by the claims and by equivalents thereto which perform substantially the same function in substantially the same way to achieve substantially the same result as the subject matter defined literally by the claims, so long as such substantial equivalents, as defines by a claim for such substantial equivalents, do not read on the prior art.

I claim:

1. A gemstone setting comprising:

(a) a first gemstone with a top table surface and an adjoining faceted outer surface;

(b) a second gemstone with a top table surface and an adjoining faceted outer surface, a section of the second gemstone comprising a cut away concave inset section with generally curved concave inner surfaces and curved edge surfaces, the concave inner surfaces of the second gemstone being located and positioned in alignment with the outer surface of the first gemstone, a substantial portion of the outer surface of the first gemstone being in flush, surface to surface, mating contact with the curved concave inner surfaces of the inset section, the curved edge surfaces of the inset section substantially enclosing said portion of the outer surface of the first gemstone within the inset section; and (c) gemstone setting means for invisibly attaching the outer surface of the first gemstone to the concave inner surface of the second gemstone.

2. The gemstone setting of claim 1 wherein the top table surfaces of the first gemstone and the second gemstone are located in the same transverse plane.

3. The gemstone setting as in claim 1 wherein the top table surfaces of the first and second gemstones are located in different transverse planes.

4. The gemstone setting as in claim 1 wherein the outer surface of the first gemstone comprises a girdle edge which encircles and is located in a parallel plane to the top table surface of the first gemstone.

5. The gemstone setting as in claim 1 wherein the faceted outer surfaces of the first and second gemstones each form a generally convex gemstone configuration.

6. The gemstone setting as in claim 1 wherein the gemstone setting means connects the outer surface of the first gemstone and the concave inner surface in flush, surface to surface, mating contact.

7. The gemstone setting as in claim 1 wherein a concave inset is formed where the second gemstone is cut away.

8. The gemstone setting as in claim 1 in which the gemstone setting means comprises grooves the faceted outer surfaces of the first and second gemstones.

9. The gemstone setting as in claim 1 wherein the gemstone setting means comprises housing means for placement of the first and second gemstones.

10. The gemstone setting as in claim 1 further comprising housing means which mounts the first gemstone such that its top table surface is in a different transverse plane than the top table surface of the second gemstone.

11. The gemstone setting as in claim 10 wherein the housing comprises an outer surface which encircles the outer surface of the first gemstone.

12. The gemstone setting as in claim 11 wherein the concave inner surface of the second gemstone is located in alignment and in flush, surface to surface mating contact with the outer surface of the housing.

13. The gemstone setting as in claim 1 further comprising a first plurality of gemstones, each of the first plurality of gemstones mounted in a housing comprising an outer surface, and a second plurality of gemstones, each of the second plurality of gemstones comprising a section which is cut away so that each of the second plurality of gemstones in part comprises a generally curved concave inner surface, the outer surfaces of the housings of the first plurality of gemstones being located in alignment to and in flush, surface to surface mating contact with the concave inner surfaces of the second plurality of gemstones.

14. The gemstone setting as in claim 13 in which the gemstone setting means connect the outer surfaces of the housings of the first plurality of gemstones in alignment to and in flush, surface to surface mating contact with the concave inner surfaces of the second plurality of gemstones.

15. The gemstone setting as in claim 1 further comprising a first plurality of gemstones, each of the first plurality of gemstones comprising a faceted outer surface, and a second plurality of gemstones, each of the second plurality of gemstones comprising a section which is cut away so that each of the second plurality of gemstones in part comprises a curved concave inner surface, the outer surfaces of the first plurality of gemstones being located in alignment to and in flush, surface to surface mating contact with the concave inner surfaces of the second plurality of gemstones.

16. The gemstone setting as in claim 15 in which the gemstone setting means connects the outer surfaces of the first plurality of gemstones in alignment to and in flush, surface to surface mating contact with the concave inner surfaces of the second plurality of gemstones.

* * * * *